US010364787B2

(12) United States Patent
Nakamura

(10) Patent No.: US 10,364,787 B2
(45) Date of Patent: Jul. 30, 2019

(54) DISCHARGE STOPPING DEVICE

(71) Applicant: Mitsubishi Electric Corporation, Tokyo (JP)

(72) Inventor: Toshifumi Nakamura, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 79 days.

(21) Appl. No.: 15/586,699

(22) Filed: May 4, 2017

(65) Prior Publication Data

US 2018/0119666 A1 May 3, 2018

(30) Foreign Application Priority Data

Nov. 2, 2016 (JP) ..... 2016-214957

(51) Int. Cl.
*F02P 11/02* (2006.01)
*F02P 5/15* (2006.01)

(52) U.S. Cl.
CPC ..... *F02P 11/02* (2013.01); *F02P 5/1502* (2013.01)

(58) Field of Classification Search
CPC .. F02P 11/02; F02P 5/1502; F02P 9/00; F02P 19/022; F02N 99/004
See application file for complete search history.

(56) References Cited

U.S. PATENT DOCUMENTS

| | | | | |
|---|---|---|---|---|
| 2008/0035131 | A1* | 2/2008 | Kraus | F02P 3/053 123/623 |
| 2016/0327008 | A1* | 11/2016 | Mao | H01T 15/00 |
| 2017/0022957 | A1* | 1/2017 | Hayashi | F02P 3/045 |
| 2017/0045025 | A1* | 2/2017 | Nakayama | F02P 3/051 |

FOREIGN PATENT DOCUMENTS

| | | | |
|---|---|---|---|
| JP | 2001-12338 | A | 1/2001 |
| JP | 2001-140739 | A | 5/2001 |
| JP | 2001-193621 | A | 7/2001 |
| JP | 3322862 | B2 | 9/2002 |
| JP | 2003-314419 | A | 11/2003 |
| JP | 3982318 | B2 | 9/2007 |
| JP | 4358370 | B2 | 11/2009 |

OTHER PUBLICATIONS

Communication dated Sep. 26, 2017 from the Japanese Patent Office issued in Japanese Patent Application No. 2016-214957.

* cited by examiner

*Primary Examiner* — Joseph J Dallo
*Assistant Examiner* — Kurt Philip Liethen
(74) *Attorney, Agent, or Firm* — Sughrue Mion, PLLC; Richard C. Turner

(57) ABSTRACT

Provided is a discharge stopping device for stopping a spark discharge during discharge, including an ignition plug, an ignition coil, a power source device, a first switch, and a controller which causes a spark discharge to be generated by controlling the switching of the first switch, the discharge stopping device further including a second switch which is disposed in a current circulation path connecting both ends of a primary coil of the ignition coil and switches the current circulation path between connected and disconnected states, wherein the controller includes a re-energization control process unit which switches the first switch to a connected state and re-energizes the primary coil with current during occurrence of the spark discharge, and a circulation control process unit which switches a second switch to a connected state and sets a current circulation path to a connected state during occurrence of the spark discharge.

8 Claims, 6 Drawing Sheets

DISCHARGE STOPPING DEVICE

BACKGROUND OF THE INVENTION

1. Field of the Invention

The present invention relates to a discharge stopping device which stops a spark discharge produced by an ignition device for an internal combustion engine, during discharge.

2. Description of the Related Art

As is well-known, there are ignition devices for an internal combustion engine of a current shut-off type which are provided with a main ignition circuit, a DC power source, and ignition control means. The main ignition circuit has an ignition coil and an ignition switch connected in series with a primary winding of the ignition coil, and a primary current energization circuit is configured by the primary winding and the ignition switch.

The DC power source outputs a DC voltage for applying to both ends of the primary current energization circuit. The ignition control means controls the ignition switch so as to be turned on at a timing before the ignition period of the internal combustion engine and then turned off in the ignition period.

Moreover, the ignition control means induces a high voltage for ignition in a secondary winding of the ignition coil, by further boosting, by the ignition coil, the high voltage (normally, around 400 V) which is induced in the primary winding of the ignition coil when the ignition switch is turned off. The ignition control means ignites the engine by applying this high voltage for ignition to an ignition plug which is installed in a cylinder of the internal combustion engine.

In an ignition device of this kind, a circuit is designed so as to be able to obtain the maximum ignition energy which is required when the engine is at low speed, for instance. Therefore, if the required ignition energy is relatively small, such as when the engine is running at high speed, then there is a problem in that the ignition energy becomes excessively large.

Conventionally, it has been proposed that the ignition energy of a current shut-off type ignition device be controlled (see, for example, Japanese Patent Application Publication No. 2001-12338, Japanese Patent Application Publication No. 2003-314419, and Japanese Patent Application Publication No. 2001-193621). In the ignition device in Japanese Patent Application Publication No. 2001-12338, a thyristor for ignition energy control is connected in parallel with respect to the primary winding of the ignition coil, in the direction in which voltage induced in the primary winding of the ignition coil during an ignition operation is applied in a forward direction between the anode and cathode.

In Japanese Patent Application Publication No. 2001-12338, the primary current of the ignition coil is shut off in the ignition period, and then the thyristor is switched on at a suitable timing and the primary winding of the ignition coil is shorted. In Japanese Patent Application Publication No. 2001-12338, by adopting a shorting operation of this kind, the ignition output is attenuated and controlled so that the ignition energy does not become excessive.

Furthermore, in Japanese Patent Application Publication No. 2003-314419, a unidirectional energization element is connected in parallel with a serial circuit comprising an ignition coil, a primary winding and an ignition switch, and after carrying out an ignition operation, a power switch is turned off, and an ignition switch is reconnected. In Japanese Patent Application Publication No. 2003-314419, the ignition energy is controlled by constituting a shorting circuit which shorts the primary winding of the ignition coil in this way.

Furthermore, apart from shorting the primary winding, it is also possible to halt a spark discharge by gradually attenuating the current in the primary winding, by using a capacitor, as in Japanese Patent Application Publication No. 2001-193621.

By providing control means for the ignition energy as described above, it is possible to prevent the ignition energy from becoming excessively high. As a result of this, it is possible to prevent unnecessary wear of the ignition plug, and the life of the ignition plug can be extended.

SUMMARY OF THE INVENTION

However, the prior art involves the following problems.

In a conventional ignition device provided with ignition energy control means based on shorting of both ends of the primary winding as described above, in the closed loop path which shorts the two ends of the primary winding, apart from the internal resistance of the primary winding, there is also a resistance component due to the on resistance of the elements which form the closed loop and the wiring resistance, etc.

Furthermore, there are also cases where a resistor is disposed in the closed loop path with the object of shortening the time from the start of the shorting operation of the primary coil until the magnetic energy in the ignition coil has been consumed completely, or with the object of suppressing generation of heat in the primary winding by distributing the consumption of energy in the event of a discharge stopping operation, between the primary winding of the ignition coil and the closed loop path. In cases of this kind, the resistance of the closed loop path of the primary winding becomes higher.

However, if the resistance of the closed loop path of the primary winding is high, then the current generated by the magnetic flux remaining in the ignition coil is restricted. As a result of this, the time from the start of the discharge stopping operation until the complete stopping of the spark discharge in the secondary winding becomes longer. Moreover, if the resistance is high, then a sufficient current for stopping the spark discharge in the secondary winding is not reached, and the spark discharge on the secondary winding side remains with a small current value.

The increase in the time until complete stopping of the discharge which occurs with the increase in the resistance of the closed loop path of the primary winding reduces the capability for controlling the ignition energy on the basis of stopping discharge. Furthermore, there is a possibility that a repeat phenomenon (multiple discharge) will occur due to the discharge being extinguished by the fluid movement inside the cylinder of the internal combustion engine, before the discharge is stopped, and then discharge occurring again. If multiple discharge of this kind occurs, then the wear of the electrodes of the ignition plug is, conversely, accelerated, thus having an adverse effect on the durability of the ignition plug.

The present invention was devised in order to resolve problems such as those described above, an object thereof being to obtain a discharge stopping device which is capable of rapidly and reliably stopping discharge by an ignition device, during the discharge.

The discharge stopping device according to the present invention includes: an ignition plug which has a first electrode and a second electrode opposing each other via a gap, and which ignites a combustible air mixture in a combustion chamber of an internal combustion engine by generating a spark discharge in the gap; an ignition coil including a primary coil and a secondary coil which is magnetically coupled with the primary coil; a power source device which supplies current to the primary coil; a first switch which is disposed between the primary coil and the power source device and which switches the current supplied from the power source device between a connected state and a disconnected state; a controller which causes the primary coil to be energized with current by switching the first switch to a connected state such that energy for causing the ignition plug to generate the spark discharge sufficient to ignite the combustible air mixture is accumulated in the primary coil, and switches the first switch to a disconnected state and shuts off the current when the energy has been accumulated in the primary coil, such that a high voltage is generated in the secondary coil and the spark discharge is generated in the gap of the ignition plug by the high voltage, the discharge stopping device further including a second switch which is disposed in a current circulation path connecting both ends of the primary coil and which switches the current circulation path between a connected state and a disconnected state, wherein the controller includes: a re-energization control process unit which switches the first switch to a connected state and re-energizes the primary coil with current during occurrence of the spark discharge; and a circulation control process unit which switches the second switch to a connected state and sets the current circulation path to a connected state during occurrence of the spark discharge, and the discharge stopping device stops the spark discharge during discharge by using the re-energization control process unit and the circulation control process unit.

According to the present invention, in addition to a first switch which switches a current supplied from a power source device to a primary coil of an ignition coil between connected and disconnected states, a second switch is provided in a current circulation path connecting both ends of the primary coil, and a re-energization control process unit which switches the first switch to a connected state and re-energizes the primary coil with current during the occurrence of a spark discharge, and a circulation control process unit which switches the second switch to a connected state and sets a current circulation path to a connected state during the occurrence of a spark discharge, are provided. As a result of this, it is possible to obtain a discharge stopping device which can rapidly and reliably stop discharge by an ignition device, during the discharge.

DESCRIPTION OF THE PREFERRED EMBODIMENTS

Below, preferred embodiments of a discharge stopping device according to this invention are described with reference to the drawings. In the embodiments below, the description relates to a single-cylinder internal combustion engine, but the present invention may also be applied to an internal combustion engine having a plurality of cylinders. In this case, a discharge stopping device having the same basic configuration may be provided for each cylinder, or a portion of the constituent elements of the discharge stopping device, such as the primary winding shorting means, may be shared between the plurality of cylinders.

First Embodiment

Figure 1:
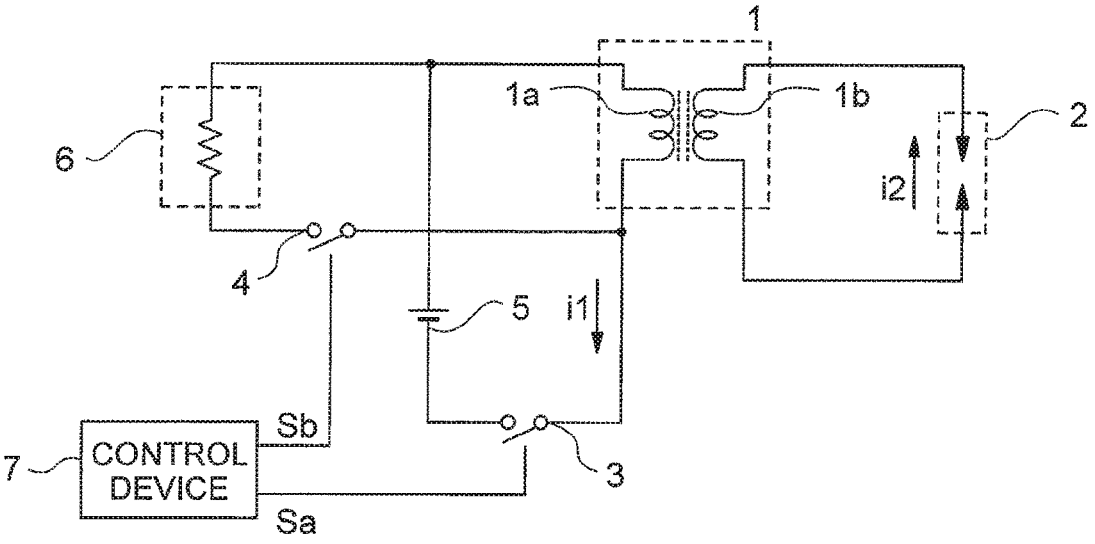
FIG. 1 is an electrical circuit diagram showing the whole configuration of a discharge stopping device according to a first embodiment of the present invention.

FIG. 1 is an electrical circuit diagram showing the whole of a discharge stopping device according to a first embodiment of the present invention. As illustrated in FIG. 1, the basic configuration illustrated in the first embodiment comprises an ignition coil 1, an ignition plug 2, a switch 3, a switch 4, a power source device 5, a resistance 6 and a control device 7.

The ignition coil 1 is configured from a primary winding 1*a* which introduces magnetic energy into the ignition coil 1, and a secondary winding 1*b* which generates a high voltage for ignition in the ignition plug 2 which is provided in the cylinder of the internal combustion engine. The switch 3 is connected in series with the primary winding 1*a* and when set to a closed state, a closed circuit is configured by the primary winding 1*a*, the switch 3 and the power source device 5.

The switch 4 is a switch for shorting both ends of the primary winding 1*a*, and a resistance 6 is connected inside the closed loop circuit which is formed by the primary winding 1*a* and the switch 4. Furthermore, the power source device 5 is a power source which supplies electrical energy for discharge. The resistance 6 represents the resistance component of the closed loop path of the primary winding 1*a* when the switch 4 is on, and has a resistance value which includes the on resistance and wiring resistance, etc. of the switch 4.

Moreover, the control device 7 controls the opening and closing of the switch 3 and the switch 4, by respectively outputting a first command signal Sa and a second command signal Sb.

One end of the primary winding 1*a* is connected to a positive electrode of the power source device 5, and the other end is connected to a negative electrode of the power source device 5 via the switch 3. The on/off state of the switch 3 is controlled by the first command signal Sa of the control device 7. On the other hand, the two ends of the secondary winding 1*b* are connected respectively to a central electrode and a lateral electrode of the ignition plug.

Furthermore, one end of the switch 4 is connected to one end of the primary winding 1*a* and the other end of the switch 4 is connected to the other end of the primary winding 1*a*, via the resistance 6. By turning on the switch 4, it is possible to short the primary winding 1*a*. The on/off state of the switch 4 is controlled by the second command signal Sb of the control device 7.

If the switch 3 is turned off by the first command signal Sa, then no current flows in the primary winding 1*a*. Furthermore, if the switch 3 is turned on by the first command signal Sa while the switch 4 is in an off state on the basis of the second command signal Sb, then a current path is formed from the positive electrode side of the power source device 5, via the primary winding 1*a* of the ignition coil, to the negative electrode side of the power source device 5, and a primary current i1 flows in the primary winding 1*a*.

Thereupon, when the switch 3 is turned off by the first command signal Sa in a state where magnetic energy has accumulated in the ignition coil due to the flow of the primary current i1 in the primary winding 1*a*, then the passage of the primary current i1 to the primary winding 1*a* is stopped, and the primary current i1 is shut off. Therefore, a high voltage for ignition is generated in the secondary winding 1*b*, and a spark discharge is generated between the electrodes of the ignition plug 2, due to this voltage being applied to the ignition plug 2.

If, during a spark discharge, the switch 3 is turned on again by the first command signal Sa at a preset timing, then re-energization starts in the primary winding 1*a*, from the positive electrode side of the power source device 5. If a magnetic field H corresponding to the magnetic flux Φ remaining in the ignition coil is generated, due to the primary current i1 caused by re-energization, then a voltage of opposite polarity to the high voltage for ignition is generated in the secondary winding 1*b*.

As a result, the spark discharge in the ignition plug 2 is stopped compulsorily. Furthermore, the time period during which the primary winding 1*a* is re-energized is controlled optimally in accordance with the remaining magnetic flux Φ in the ignition coil 1, by the re-energization time calculation means in the control device 7.

Next, the control device 7, by turning on the switch 4 by the second command signal Sb, causes the two ends of the primary winding 1*a* of the ignition coil 1 to be shorted, thereby forming a closed loop by the primary winding 1*a*, the switch 4 and the resistance 6, and in this state, the control device 7 turns off the switch 3 by the first command signal Sa. Therefore, current starts to flow in the closed loop formed in the primary winding 1*a*, by the magnetic flux energy in the ignition coil 1, and the magnetic energy remaining in the ignition coil is consumed by the resistance component in the closed loop.

If the ignition switch 3 is turned off while the switch 4 that shorts the primary winding 1*a* is in an off state, a high voltage for ignition is generated in the secondary winding 1*b* at the time that re-energization is completed, and a repeat discharge occurs. Consequently, it is necessary to turn on the switch 4 that shorts the primary winding 1*a*, at a time before the ignition switch 3 is turned off.

Thereafter, the magnetic energy in the ignition coil is consumed completely, the switch 4 is turned off, and the shorting of the primary winding is released. In this way, the spark discharge in one combustion cycle of the internal combustion engine is ended.

The series of steps of the discharge stopping device according to the first embodiment is described here on the basis of the basic configuration illustrated in FIG. 1. However, this illustration is conceptual, and therefore a configuration of the discharge stopping device which envisages the actual implementation of the discharge stopping device of the present invention and depicts a more specific implementation of the configuration in FIG. 1 is described with reference to FIG. 2.

Figure 2:
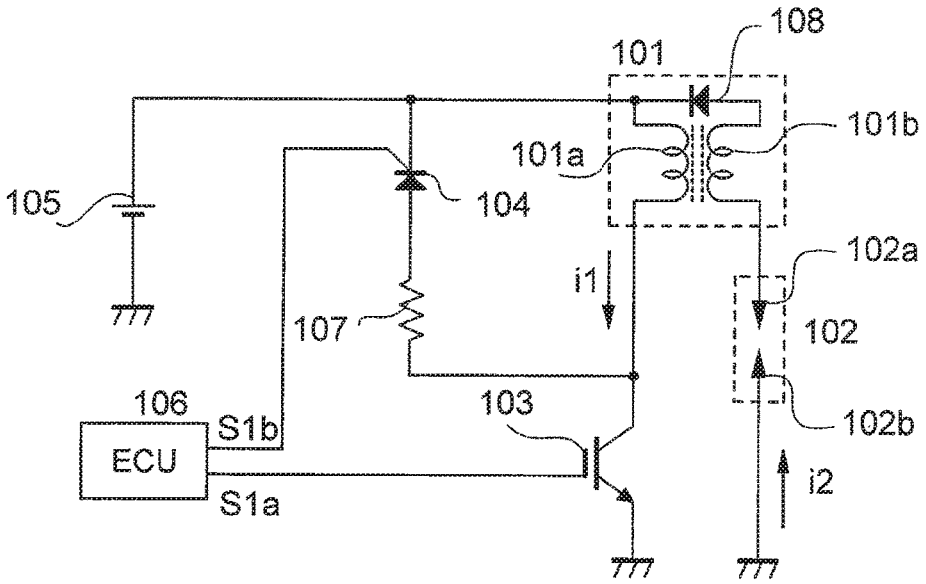
FIG. 2 is an electrical circuit diagram showing the specific configuration of a discharge stopping device according to the first embodiment of the present invention.

FIG. 2 is an electrical circuit diagram showing the specific configuration of the discharge stopping device according to the first embodiment of the present invention. As illustrated in FIG. 2, the discharge stopping device which incorporates a specific embodiment of the circuit configuration in FIG. 1 is provided with an ignition coil 101, an ignition plug 102, an IGBT 103, a thyristor 104, a power source device (battery) 105, an electronic control device (called "ECU" below) 106, and a resistance 107.

The ignition coil 101 is configured from a primary winding 101*a*, a secondary winding 101*b* and a rectifying element 108. The ignition plug 102 is provided in a cylinder of an internal combustion engine. The IGBT 103 is connected in series with the primary winding 101*a*. The thyristor 104 is connected in parallel with the primary winding 101*a*, in order to short both ends of the primary winding 101*a*. The power source device (battery) 105 supplies magnetic energy for discharge (a voltage of 12 V, for example).

Moreover, the electronic control device (called "ECU" below) 106 respectively outputs the first command signal S1*a* and the second command signal S1*b* to the IGBT 103 and the thyristor 104.

Furthermore, the resistance 107 is connected in series to the thyristor 104. The resistance 107 represents the resistance component of the closed loop path of the primary winding 101*a* when the thyristor 104 is on, and has a resistance value which includes the on resistance and wiring resistance, etc. of the thyristor 104.

One end of the primary winding 101*a* is connected to the positive electrode of the power source device 105, and the other end thereof is connected to the collector of the IGBT 103. Furthermore, one end of the secondary winding 101*b* is connected to the one end of the primary winding 101*a* that is connected to the positive electrode of the power source device 105, via the rectifying element 108, and the other end thereof is connected to the central electrode 102*a* of the ignition plug 102.

The lateral electrode 102*b* of the ignition plug 102 is earthed to a ground of the same potential as the negative electrode of the power source device 105. The base of the IGBT 103 is connected to the ECU 106, and the emitter of the IGBT 103 is earthed to ground.

Furthermore, the cathode of the thyristor 104 is connected to the connection end of the primary winding 101*a* and the power source device 105, the anode of the thyristor 104 is connected to the connection end of the primary winding 101*a* and the IGBT 103 via the resistance 107, and the gate of the thyristor 104 is connected to the ECU 106.

When the first command signal S1*a* output from the ECU 106 to the IGBT 103 is at a low level (generally, ground potential), then a base current does not flow in the IGBT 103 and the IGBT 103 is off. Consequently, no current flows in the primary winding 101*a* through the IGBT 103.

Furthermore, if the first command signal S1*a* is at a high level, then the IGBT 103 assumes an on state. Consequently, an energization path of the primary winding 101*a* is formed from the positive electrode side of the power source device 105, through the primary winding 101*a* of the ignition coil 101, to the negative electrode side of the power source device 105, and a primary current i1 flows in the primary winding 101*a*.

Consequently, the first command signal S1*a* assumes a high level, and when the first command signal S1*a* is switched to a low level while the primary current i1 is flowing in the primary winding 101*a*, then the IGBT 103 is turned off, the energization of the primary winding 101*a* with the primary current i1 is stopped, and the primary current i1 is shut off.

Therefore, a high voltage for ignition is generated in the secondary winding 101*b* of the ignition coil 101. By applying this high voltage for ignition to the ignition plug 102, a spark discharge is generated between the electrodes 102*a* and 102*b* of the ignition plug 102.

The ignition coil 101 is configured in such a manner that a negative high voltage for ignition which is lower than the ground potential is generated on the central electrode 102*a* side of the ignition plug 102, by shutting off the energization of the primary winding 101*a* by means of the IGBT 103. As a result of this, the secondary current i2 flowing in the secondary winding 101*b* in accordance with the spark discharge flows from the central electrode 102*a* of the ignition plug 102, through the secondary winding 101*b*, to the primary winding 101*a* side.

Furthermore, a rectifying element 108 constituted by a diode, or the like, is provided in the connecting portion between the secondary winding 101*b* and the primary winding 101*a*, in order to permit the flow of current in the forward direction from the secondary winding 101*b* to the primary winding 101*a* side, and to inhibit the flow of current in the opposite direction.

In the specific example in the first embodiment illustrated in FIG. 2, a diode of which the anode is connected to the secondary winding 101*b* and the cathode is connected to the primary winding 101*a* is provided as the rectifying element 108. Current is prevented from flowing to the secondary winding 101*b* when the IGBT 103 is turned on, in other words, at the start of the energization of the primary winding 101*a*, by the operation of this rectifying element 108.

Next, when the second command signal S1*b* output from the ECU 106 to the thyristor 104 is at low level, the thyristor 104 assumes an off state. Therefore, the two ends of the primary winding 101*a* are never shorted by the thyristor 104.

Furthermore, if the second command signal S1*b* is at a high level, then the thyristor 104 assumes an on state, and the two ends of the primary winding 101*a* of the ignition coil 101 are shorted. As a result of this, a closed loop is formed by the primary winding 101*a*, the thyristor 104 and the resistance 107.

When the thyristor 104 is on, the current flowing in the primary winding 101*a* is permitted to flow only in the same direction as the direction in which the current flows when the IGBT 103 is on. In the circuit configuration in FIG. 2, one end of the rectifying element 108 is connected to the side of the secondary winding 101*b*, but if a configuration is employed in which one end of the rectifying element 108 is connected to ground, a similar effect is obtained by this configuration.

Figure 3:
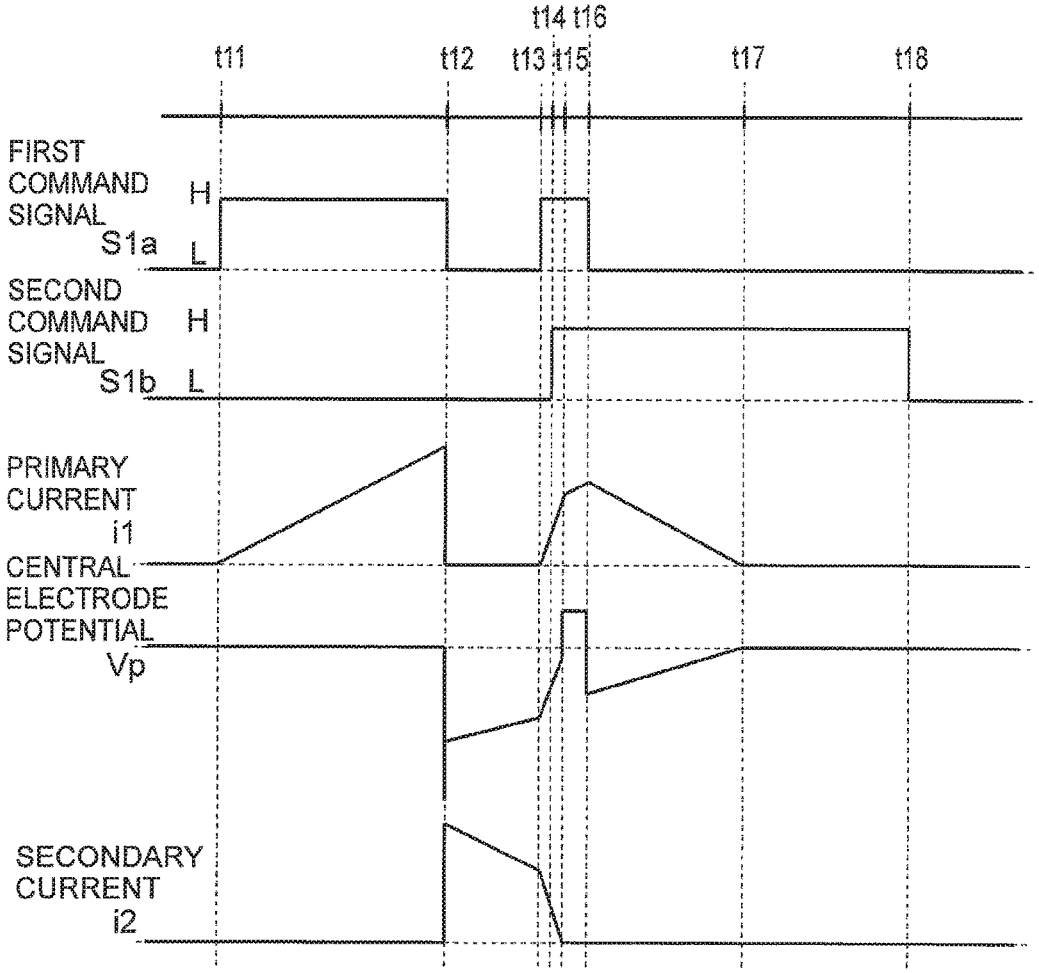
FIG. 3 is a time chart illustrating the waveforms of the respective units of a discharge stopping device provided with the circuit configuration in FIG. 2 according to the first embodiment of the present invention.

Next, a series of operations of the circuit configuration in FIG. 2 will be described with reference to a timing chart. FIG. 3 is a time chart illustrating the waveforms of the respective units of a discharge stopping device provided with the circuit configuration in FIG. 2 according to the first embodiment of the present invention.

More specifically, FIG. 3 shows a timing chart depicting, in order from the top, the states of the first command signal S1*a*, the second command signal S1*b*, the primary current i1 flowing in the primary winding 101*a* of the ignition coil 101, the potential Vp of the central electrode 102*a* of the ignition plug 102, and the secondary current i2 flowing in the secondary winding 101*b* of the ignition coil 101, in the circuit diagram illustrated in FIG. 2.

At time t11, the ECU 106 switches the first command signal S1*a* from low level to high level. As a result of this, a primary current i1 flows in the primary winding 101*a* of the ignition coil 101. Thereupon, the ECU 106 switches the first command signal S1*a* from high level to low level, at time t12 when a preset energization time has elapsed, and the energization of the primary winding 101*a* of the ignition coil 101 with the primary current i1 is shut off.

As a result of this shutting off, a negative high voltage for ignition is applied to the central electrode 102*a* of the ignition plug 102, the potential Vp thereof falls suddenly, and a spark discharge is generated between the electrodes 102*a* and 102*b* of the ignition plug 102.

At time t13 when a spark discharge hold time, which is calculated on the basis of the operational state of the internal combustion engine, has elapsed after generation of a spark discharge between the electrodes 102*a* and 102*b* of the ignition plug 102, the ECU 106 switches again the first command signal S1*a* from low level to high level. As a result of this, a primary current i1 for re-energization starts to flow in the primary winding 101*a*.

At time t15 where the primary current i1 for re-energization reaches a current value which generates a magnetic field H corresponding to the magnetic flux Φ remaining in the iron core of the ignition coil 101, a voltage of opposite polarity to the high voltage for ignition that was generated in the secondary winding 101*b* during generation of a spark is induced in the secondary winding 101*b*. As a result of this, when the voltage between the electrodes 102*a* and 102*b* falls below the discharge hold voltage, the spark discharge in the ignition plug 102 is compulsorily shut off.

The greater the magnetic flux Φ remaining in the iron core, the higher the primary current i1 at which the spark discharge is stopped. Therefore, the greater the magnetic flux Φ remaining in the iron core, the longer the required re-energization reactivation time.

If re-energization continues after the discharge has stopped, then an unnecessary magnetic flux Φ is stored additionally in the coil. Therefore, the ECU 106 stops re-energization by switching the first command signal S1*a* again from high level to low level, at a re-energization end time t16 which is calculated by the re-energization time calculation means.

At time t14, which is before time t16, the ECU 106 shorts the two ends of the primary winding 101*a*, by switching the second command signal S1*b* from low to high level and turning the thyristor 104 on. As a result of this, after re-energization, the primary current i1 starts to flow in the closed loop formed by the primary winding 101*a*, the thyristor 104 and the resistance 107, due to the magnetic flux Φ remaining in the ignition coil 15.

Here, the time t14 at which the thyristor 104 is switched on may be any time between time t13 and time t16.

In this case, when the resistance component 107 of the closed loop path of the primary winding 101*a* becomes greater, the primary current i1 does not rise up to a current value that generates a magnetic field H corresponding to the magnetic flux Φ, and a voltage of the same polarity as the high voltage for ignition is generated again in the ignition plug 102. However, the repeat insulation breakdown voltage is a much higher voltage (several kV to several tens of kV) than the discharge hold voltage (approximately several hundred V). Therefore, a repeat spark discharge does not occur between the electrodes 102*a* and 102*b* of the ignition plug 102.

The magnetic flux Φ remaining in the ignition coil 101 is consumed by the internal resistance of the primary winding 101*a* and the resistance component 107 of the closed loop path, and the primary current i1 gradually declines. Therefore, at time t17 where the magnetic flux has been consumed, the primary current i1 ceases to flow.

Thereupon, at time t18, the ECU 106 turns off the thyristor 104 by switching the second command signal S1*b* from a high level to a low level. As a result of this, the closed loop formed by the primary winding 101*a* and the thyristor 104 is released. In this way, the spark discharge in one combustion cycle of the internal combustion engine is ended.

Next, the calculation process performed by the re-energization time calculation means will be described with reference to the timing chart in FIG. 3 described above. The re-energization time calculation means calculates the re-energization time in such a manner that the cutting off of the discharge between the electrodes of the ignition plug 102 is guaranteed, while avoiding storage of a wasted magnetic flux in the coil. In other words, the re-energization time must be set in such a manner that the time period from the time t15 at which the discharge between the electrodes of the ignition plug 102 is cut off, to the time t16 at which the re-energization ends, is short.

Re-Energization Time Calculation by Re-Energization Time Calculation Means: First Example In a first calculation example, the re-energization time calculation unit calculates the re-energization time by using the initial energization time in the primary winding (called "primary energization time" below) and the spark discharge hold time. The magnetic flux Φ in the ignition coil 1 is a maximum at the time t12 which is when the primary energization is shut off, and the magnetic flux Φ is progressively consumed while the spark discharge continues in the ignition plug 102.

Consequently, the shorter the discharge hold time that corresponds to the interval between time t12 and time t13, the greater the magnetic flux remaining in the ignition coil. Therefore, the shorter the spark discharge time, the higher the value of the re-energization current in the primary winding that is required to stop the discharge, and the longer the re-energization time corresponding to interval between the time t13 and the time t16 which is set by the re-energization time calculation means.

For example, the calculated re-energization time can be envisaged as:

$$\text{re-energization time}=(\alpha\times\text{primary energization time}\times\text{ratio of remaining magnetic flux}).$$

Here, desirably, $$\alpha=(\alpha1/\alpha2),\text{ and}$$

α1 is a current value which generates a magnetic field H corresponding to the magnetic flux Φ, and α2 is the rate of increase of the current value in the re-energization period which corresponds to the period from the start of re-energization to the stopping of discharge. α1 and α2 can be determined from the experimental data and design parameters of the ignition coil.

Furthermore, the remaining magnetic flux ratio is the ratio of the magnetic flux Φ remaining in the ignition coil at the start of the stopping of discharge, taking the magnetic flux Φ at the end of primary energization as the maximum, and the following relationship is considered to be satisfied:

$$\text{Ratio of remaining magnetic flux}=(1-(\text{discharge hold time}/\text{normal discharge hole time})).$$

Here, the normal discharge hold time is the spark discharge hold time under the same discharge conditions as when stopping of discharge is not performed.

For example, if the primary energization time is 5 [ms], the discharge hold time is 0.2 [ms], the normal discharge hold time is 2 [ms] and the value of α determined by experimentation is 0.02, then the ratio of remaining magnetic flux is 0.9 and the re-energization time can be calculated as 0.09 [ms].

By setting the re-energization stop time t16 on the basis of the re-energization time calculated in this way, it is possible to pass a re-energization current that is capable of shutting off the discharge in the ignition plug 102.

Therefore, by setting the time t16 appropriately, re-energization is not carried out for longer than necessary and therefore unnecessary generation of heat in the coil is suppressed. The calculation of the re-energization time may be performed at each ignition cycle or may be performed by using a preset map.

Figure 4:
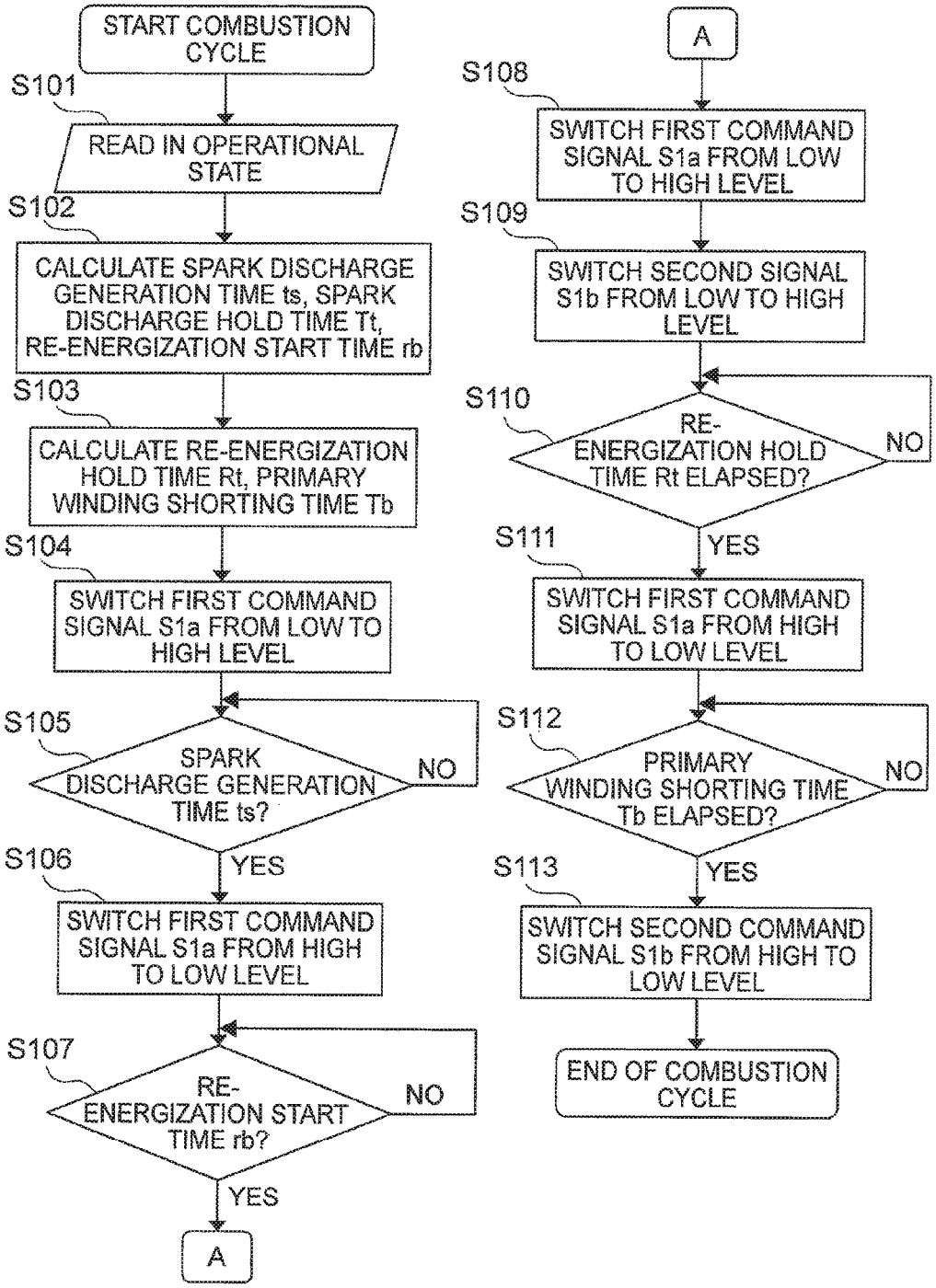
FIG. 4 is a flowchart of an ignition control process that is executed by the ECU according to the first embodiment of the present invention.

Next, the ignition control process executed in the ECU 106 is described with reference to a flowchart. FIG. 4 is a flowchart of an ignition control process that is executed by the ECU 106 according to the first embodiment of the present invention. The flowchart in FIG. 4 corresponds to the circuit configuration in FIG. 3, for example.

The ECU 106 serves to perform integrated control of the spark discharge generation time, the fuel consumption amount, the idling revolutions, etc. of the internal combustion engine. Moreover, the ECU 106 carries out an operational state detection process for separately detecting the operational states of the respective parts of the internal combustion engine, such as the intake air volume (intake cylinder pressure), rotational speed, throttle opening, cooling water temperature, intake air temperature, and the like, of the engine, for the purpose of the ignition control process described below.

The ignition control process is executed at a rate of once in each combustion cycle in which the internal combustion engine performs intake, compression, combustion and exhaust actions, on the basis of a signal from a crank angle sensor which detects the angle of rotation (crank angle) of the internal combustion engine, for example.

When the ignition control process is started, firstly, in step S101, the ECU 106 reads in the operational state of the engine as detected in an operational state detection process, which is executed separately.

Next, in step S102, the ECU 106 calculates a spark discharge generation time (so-called ignition time) ts and a spark discharge hold time Tt, on the basis of the operational states read out, and also calculates the re-energization start time rb from the spark discharge generation time ts and the spark discharge hold time Tt.

The spark discharge generation time ts is, for example, calculated by a procedure in which a control reference value is determined using a calculation formula or a map based on the intake air volume and rotational speed of the internal combustion engine as parameters, and this reference value is then corrected on the basis of the cooling water temperature and intake air temperature, etc.

Furthermore, the spark discharge hold time Tt is calculated by using a preset map or calculation formula, on the basis of the rotational speed of the internal combustion engine and the throttle opening which represents the engine load, for example, so as to be longer under first operational conditions where the spark energy required in order to combust the air mixture is large and shorter under second operational conditions where a small spark energy is sufficient. More specifically, the first operational conditions correspond to low-load, low-speed rotation, etc. of the internal combustion engine and the second operational conditions correspond to high-load, high-speed rotation, etc. thereof.

Here, the spark discharge generation time ts is B20°, and the spark discharge hold time Tt is 0.2 [ms]. Furthermore, to ignite the air mixture, the spark discharge time should be set to not less than 0.05 [ms]. Consequently, the re-energization start time rb at which re-energization of the primary winding is started is set to a time at which the spark discharge hold time Tt=0.2 [ms] has elapsed, counting from the timing of the spark discharge generation time is =B20°.

Next, in step S103, the ECU 106 calculates the re-energization hold time Rt, and the primary winding shorting time Tb, by the re-energization hold time calculation unit.

The re-energization hold time Rt is calculated using a preset map or calculation formula, on the basis of the primary energization time and the spark discharge hold time Tt, so as to be shorter when the re-energization current value at which the spark discharge stops is low, and so as to be longer when the re-energization current value at which the spark discharge stops is high.

More specifically, a case where the re-energization current value at which the spark discharge stops is low corresponds to a case where the magnetic flux Φ remaining in the ignition coil 101 is low, and a case where the re-energization current at which the spark discharge stops is high corresponds to a case where the magnetic flux Φ remaining in the ignition coil 101 is high.

Here, the calculated re-energization hold time Rt is set to 0.05 [ms]. To control generation of heat produced by the re-energization, the re-energization hold time Rt should be set in a range of not more than 0.5 [ms].

Moreover, the primary winding shorting time Tb is calculated using a preset map or calculation formula, on the basis of the spark discharge hold time Tt, for example, so as to continue an on state of the thyristor 104 until the magnetic flux Φ remaining in the ignition coil 101 has been consumed.

The primary winding shorting time Tb is set to be shorter when the spark discharge hold time Tt is long, and so as to be longer when the spark discharge hold time Tt is short (when the magnetic flux Φ remaining in the ignition coil 101 is large).

More specifically, a case where the spark discharge hold time Tt is long corresponds to a case where the magnetic flux Φ remaining in the ignition coil 101 is small, and a case where the spark discharge hold time Tt is short corresponds to a case where the magnetic flux Φ remaining in the ignition coil 101 is large. Here, the primary winding shorting time Tb is set to 7 [ms].

Next, in step S104, the ECU 106 determines the energization start time of the primary winding 101*a* at a time that is a preset primary energization time earlier than the spark discharge generation time ts calculated in step S102. The ECU 106 then changes the first command signal S1*a* from low level to high level, at the time point that the energization start time is reached, in other words, at time t11 indicated in FIG. 3 above.

When the first command signal S1*a* is switched from low level to high level, the IGBT 103 assumes an on state. Consequently, a primary current i1 flows in the primary winding 101*a* of the ignition coil 101.

In step S105, the ECU 106 determines whether or not the spark discharge generation time ts calculated in step S102 has been reached, on the basis of a detection signal from the crank angle sensor. If the determination is NO, then the ECU 106 waits until the spark discharge generation time ts is reached, by repeatedly executing the same step.

On the other hand, if the ECU 106 determines, in step S105, that the spark discharge generation time ts has been reached, in other words, that time t12 has been reached, then the ECU 106 transfers to step S106.

Thereupon, in step S106, the ECU 106 reverses the first command signal S1*a* from high level to low level, as indicated at time t12 in FIG. 3. As a result of this, the IGBT 103 is turned off, the primary current i1 is shut off, a high voltage for ignition is induced in the secondary winding 101*b* of the ignition coil 101, and a spark discharge is generated between the electrodes 102*a* and 102*b* of the ignition plug 102.

Subsequently, in step S107, the ECU 106 determines whether or not the re-energization start time rb which is set so as to start the shutting off of the spark discharge at the spark discharge hold time Tt calculated in step S102 has been reached, after determining in step S105 that the spark discharge generation time is has been reached. If the ECU 106 determines that the re-energization start time rb has been reached, in other words, determines that the time t13 has been reached, then the ECU 106 transfers to step S108.

Next, in step S108, the ECU 106 switches the first command signal S1*a* from low level to high level. Consequently, re-energization occurs in the primary winding 101*a* of the ignition coil 101, from the power source device 105, and a current i1 starts to flow.

Thereupon, in step S109, the ECU 106 switches the second command signal S1*b* from low level to high level. This process must be carried out until the first command signal S1*a* is switched from high level to low level in step S111, which is described below.

Subsequently, in step S110, the ECU 106 determines whether or not the re-energization hold time Rt which is set so as to start the shutting off of the spark discharge at the spark discharge hold time Tt calculated in step S103 has been reached, after determining in step S107 that the re-energization start time rb has been reached. If the ECU 106 determines that the re-energization hold time Rt has been reached, in other words, determines that the time t16 has been reached, then the ECU 106 transfers to step S111.

In step S111, the ECU 106 switches the first command signal S1*a* from high level to low level. Consequently, the re-energization of the primary winding 101*a* of the ignition coil 101 from the power source device 105 is halted. Simultaneously with this, a primary current i1 starts to flow in the closed loop formed by the primary winding 101*a* and the thyristor 104, due to the magnetic flux remaining in the ignition coil 101.

After this step, the magnetic flux remaining in the ignition coil 101 is consumed by the internal resistance of the primary winding 101*a* and by the resistance 107, and the primary current i1 flowing in the closed loop of the primary winding 101*a* and the thyristor 104 declines.

Subsequently, in step S112, the ECU 106 determines whether or not the primary winding shorting time Tb calculated in step S103 has elapsed, after the second command signal S1*b* has been changed from low level to high level in step S109. If the determination is YES, then the ECU 106 transfers to step S113, and if the determination is NO, then the ECU 106 waits by repeatedly carrying out the same step.

When the primary winding shorting time Tb has passed and the time t18 is reached, in step S113, the ECU 106 reverses the second command signal S1*b* from high level to low level and then terminates the ignition control process.

Re-Energization Time Calculation by Re-Energization Time Calculation Means: Second Example In a second calculation example, the re-energization time calculation unit calculates the re-energization time on the basis of the change in the current in the primary winding 101*a* during re-energization. This case is especially effective in situations, for example, where the fluid movements inside the cylinder of the internal combustion engine cause the spark discharge to travel and lengthen, or where there is a change in the discharge path.

In cases of this kind, the rate of decrease in the magnetic flux Φ while the spark discharge is continuing in the ignition plug 102 varies greatly with the discharge conditions inside the engine cylinder. Therefore, the magnetic flux Φ remaining in the ignition coil is not the same, even if the spark discharge hold time is the same. In other words, in an actual cylinder of an internal combustion engine, it is difficult to calculate a re-energization time that suits the magnetic flux Φ remaining in the ignition coil, by calculation based on the primary energization time and the spark discharge hold time.

The value of the re-energization current rises sharply up to time t15 where a magnetic field H corresponding to the magnetic flux Φ remaining in the ignition coil is generated and the spark discharge in the ignition plug 102 is stopped. Meanwhile, after time t15 at which the spark discharge is stopped, the magnetic flux Φ is accumulated further in the iron core of the ignition coil 101, and therefore the rate of increase in the re-energization current after time t15 is diminished. Therefore, in the second calculation example, the re-energization time calculation unit detects a discharge stopping completion time t15, on the basis of the change in current.

For example, the re-energization time calculation unit acquires the differential value of the re-energization current, and determines that the discharge stopping completion time t15 has passed and a transfer to recharging of the coil has been made, when the differential value of the current falls below a preset threshold value at a certain time after the start of re-energization. If this time is taken as the re-energization stop time t16, then time t16 is the setting of the re-energization time that suits the remaining magnetic flux Φ in the coil.

By stopping re-energization at time t16 calculated as described above, it is possible to cause a re-energization current capable of shutting off discharge in the ignition plug 102, even if the magnetic flux Φ at the discharge stopping start time t13 is unknown, and furthermore re-energization is not carried out for an unnecessarily long time and unwanted generation of heat in the coil can be suppressed.

When calculating the time t16, it is necessary to provide a current detector for detecting change in the re-energization current flowing in the primary winding 101*a* during re-energization, as part of the configuration of the discharge stopping device.

Figure 5:
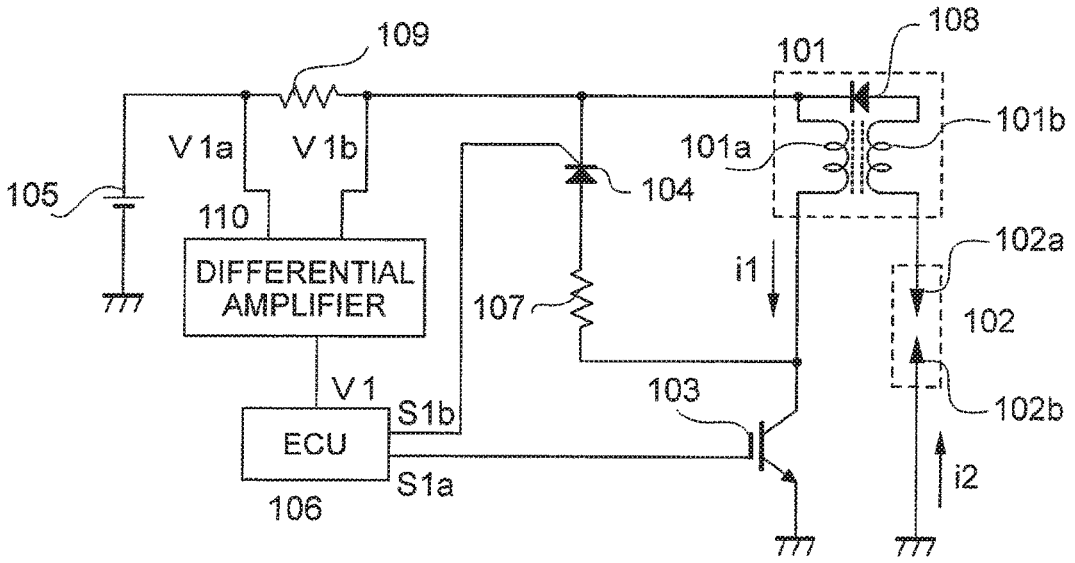
FIG. 5 is an electrical circuit diagram showing the specific configuration of a discharge stopping device provided with a current detector according to the first embodiment of the present invention.

FIG. 5 is an electrical circuit diagram showing the specific configuration of a discharge stopping device provided with a current detector according to the first embodiment of the present invention. A current detection resistance 109 is installed in series between the positive electrode terminal of the power source device 105 and the primary winding 101*a*. Voltage V1*a* and voltage V1*b* at both ends of the current detection resistance 109 are input to a differential amplifier 110.

The ECU 106 then measures the output V1 that is obtained by amplifying the voltage drop between the two ends of the current detection resistance 109, by the differential amplifier 110. The ECU 106 converts the output V1 to a current value.

Figure 6:
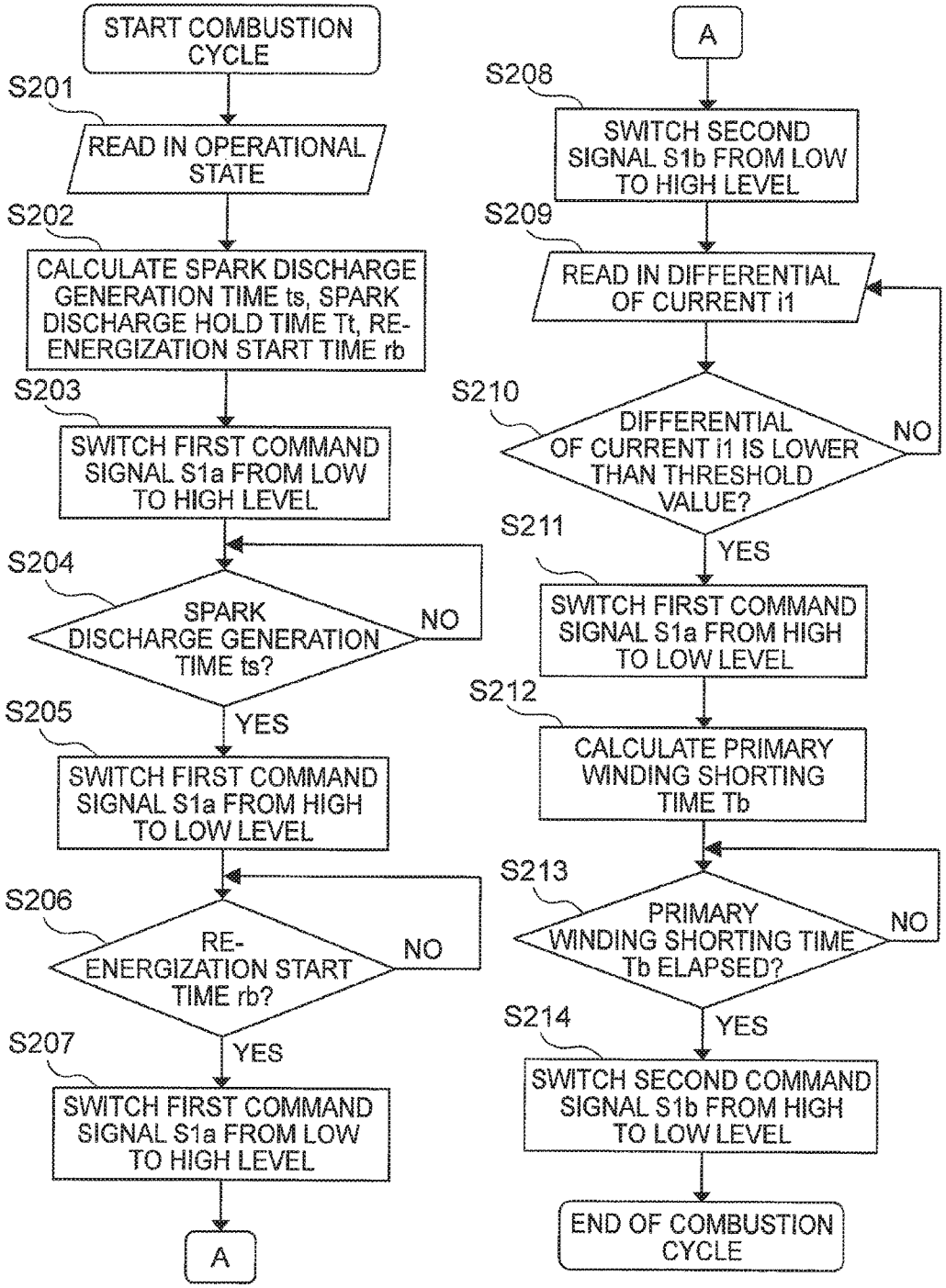
FIG. 6 is a flowchart of an ignition control process that is executed by the ECU according to the first embodiment of the present invention.

Next, the ignition control process executed in the ECU 106 is described with reference to a flowchart. FIG. 6 is a flowchart of an ignition control process that is executed by the ECU 106 according to the first embodiment. The flowchart in FIG. 6 corresponds to the circuit configuration in FIG. 5, for example.

The ECU 106 serves to perform integrated control of the spark discharge generation time, the fuel consumption amount, and the idling revolutions, etc. of the internal combustion engine. Moreover, the ECU 106 carries out an operational state detection process for separately detecting the operational states of the respective parts of the internal combustion engine, such as the intake air volume (intake cylinder pressure), rotational speed, throttle opening, cooling water temperature, intake air temperature, and the like, of the engine, for the purpose of the ignition control process described below.

The ignition control process is executed at a rate of once in each combustion cycle in which the internal combustion engine performs intake, compression, combustion and exhaust actions, on the basis of a signal from a crank angle sensor which detects the angle of rotation (crank angle) of the internal combustion engine, for example.

When the ignition control process is started, firstly, in step S201, the ECU 106 reads in the operational state of the engine as detected in an operational state detection process, which is executed separately.

Next, in step S202, the ECU 106 calculates a spark discharge generation time (so-called ignition time) is and a spark discharge hold time Tt, on the basis of the operational states read out, and also calculates the re-energization start time rb.

The spark discharge generation time ts is, for example, calculated by a procedure in which a control reference value is determined using a calculation formula or a map based on the intake air volume and rotational speed of the internal combustion engine as parameters, and this reference value is then corrected on the basis of the cooling water temperature and intake air temperature, etc.

Furthermore, the spark discharge hold time Tt is calculated by using a preset map or calculation formula, on the basis of the rotational speed of the internal combustion engine and the throttle opening which represents the engine load, for example, so as to be longer under first operational conditions where the spark energy required in order to combust the air mixture is large and shorter under second operational conditions where a small spark energy is sufficient. More specifically, the first operational conditions correspond to low-load low-speed rotation, etc. of the internal combustion engine and the second operational conditions correspond to high-load high-speed rotation, etc. thereof.

Here, the spark discharge generation time ts is B20°, and the spark discharge hold time Tt is 0.2 [ms]. Furthermore, to ignite the air mixture, the spark discharge time should be set to not less than 0.05 [ms]. Consequently, the re-energization start time rb at which re-energization of the primary winding is started is set to a time at which the spark discharge hold time Tt=0.2 [ms] has elapsed, counting from the timing of the spark discharge generation time ts=B20°.

Next, in step S203, the ECU 106 determines the energization start time of the primary winding 101*a* at a time that is a preset primary energization time earlier than the spark discharge generation time ts calculated in step S202. The ECU 106 then changes the first command signal S1*a* from low level to high level, at the time point that the energization start time is reached, in other words, at time t11 indicated in FIG. 3 above.

By the process in step S203, when the first command signal S1*a* is switched from low level to high level, the IGBT 103 assumes an on state. Consequently, a primary current i1 flows in the primary winding 101*a* of the ignition coil 101.

At step S204, the ECU 106 determines whether or not the spark discharge generation time ts calculated in step S202 has been reached, on the basis of a detection signal from the crank angle sensor. If the determination is NO, then the ECU 106 waits until the spark discharge generation time ts is reached, by repeatedly executing the same step.

On the other hand, if the ECU 106 determines, at step S204, that the spark discharge generation time ts has been reached, in other words, that time t12 has been reached, then the ECU 106 transfers to step S205.

Thereupon, in step S205, the ECU 106 reverses the first command signal S1*a* from high level to low level, as indicated at time t12 in FIG. 3. As a result of this, the IGBT 103 is turned off, the primary current i1 is shut off, a high voltage for ignition is induced in the secondary winding 101*b* of the ignition coil 101, and a spark discharge is generated between the electrodes 102*a* and 102*b* of the ignition plug 102.

Subsequently, in step S206, the ECU 106 determines whether or not the re-energization start time rb which is set so as to start the shutting off of the spark discharge at the spark discharge hold time Tt calculated in step S202 has been reached, after determining in step S204 that the spark discharge generation time ts has been reached. If the ECU 106 determines that the re-energization start time rb has been reached, in other words, determines that the time t13 has been reached, then the ECU 106 transfers to step S207.

Next, in step S207, the ECU 106 switches the first command signal S1*a* from low level to high level. Consequently, re-energization occurs in the primary winding 101*a* of the ignition coil 101, from the power source device 105, and a current i1 starts to flow.

Thereupon, in step S208, the ECU 106 switches the second command signal S1*b* from low level to high level. This process must be carried out until the first command signal S1*a* is switched from high level to low level in step S201, which is described below.

Next, in step S209, the ECU 106 reads in the differential value of the current i1. Thereupon, the ECU 106 transfers to step S210. Subsequently, in step S210, the ECU 106 determines whether or not the differential value of the current i1 is below a preset threshold value. If the determination is NO, then the ECU 106 returns again to step S209 and thereby waits until the differential value of the current i1 falls below the threshold value.

On the other hand, if the time t16 at which the differential value of the current i1 falls below the preset threshold value has been reached, then the ECU 106 determines that the stopping of discharge has been completed. Here, given that previous experimentation into the stopping of discharge indicates that the current differential value from the start of re-energization to the completion of shut-off of the discharge is 30 [A/ms] and the current differential value when magnetic flux is accumulated in the coil after completion of shut-off of the discharge is 2 [A/ms], then the threshold value is set in a range from 2 to 30 [A/ms].

The threshold value may be set to a low value to ensure complete shut-off of the discharge. For example, the threshold value is set to be no more than 10 [A/ms].

Next, in step S211, the ECU 106 switches the first command signal S1*a* from high level to low level. Consequently, the re-energization of the primary winding 101*a* of the ignition coil 101 from the power source device 105 is halted. Simultaneously with this, a primary current i1 starts to flow in the closed loop formed by the primary winding 101*a* and the thyristor 104, due to the magnetic flux remaining in the ignition coil 101.

After this step, the magnetic flux remaining in the ignition coil 101 is consumed by the internal resistance of the primary winding 101*a* and by the resistance 107, and the primary current i1 flowing in the closed loop of the primary winding 101*a* and the thyristor 104 declines.

Next, in step S212, the ECU 106 calculates the primary winding shorting time Tb, which is the elapsed time after switching to high level in step S208. For example, the ECU 106 calculates the primary winding shorting time Tb by using a preset map or calculation formula, on the basis of a re-energization time corresponding to the time period from step S208 to step S211, in such a manner that the on state of the thyristor 104 is continued until the magnetic flux Φ remaining in the ignition coil 101 is consumed.

The primary winding shorting time Tb is set to be shorter when the re-energization time is longer, and longer when the re-energization time is shorter. More specifically, a case where the re-energization time is long corresponds to a case where the magnetic flux Φ remaining in the ignition coil 101 is small, and a case where the re-energization time is short corresponds to a case where the magnetic flux Φ remaining in the ignition coil 101 is large. Here, the primary winding shorting time Tb is set to 7 [ms].

Subsequently, in step S213, the ECU 106 determines whether or not the primary winding shorting time Tb calculated in step S212 has elapsed, after the second command signal S1*b* has been changed from low level to high level in step S208. If the determination is YES, then the ECU 106 transfers to step S214, and if the determination is NO, then the ECU 106 waits by repeatedly carrying out the same step.

When the primary winding shorting time Tb has passed and the time t18 is reached, in step S214, the ECU 106 reverses the second command signal S1*b* from high level to low level and then terminates the ignition control process.

In the timing chart in FIG. 3, time t12 corresponds to the spark discharge generation time ts, the time period from time t12 to time t15 corresponds to the spark discharge hold time Tt, time t13 corresponds to the re-energization start time rb, and the time period from time t13 to time t16 corresponds to the re-energization hold time Rt.

As described above, the discharge stopping device according to the first embodiment is provided with a re-energization control process unit which switches a first switch to a connected state during the occurrence of a spark discharge and re-energizes the primary coil with current, and a circulation control process unit which switches a second switch, that is disposed in a current circulation path connecting one primary coil and another primary coil, to a connected state during the occurrence of a spark discharge, thereby setting the current circulation path to a connected state.

As a result of this, by stopping spark discharge by using a re-energization device and a circulation device, it is possible to rapidly and reliably stop a spark discharge during the discharge.

Moreover, since the re-energization device is caused to stop re-energization by switching the first switch to a disconnected state when the current circulation path has been set to a connected state by the circulation device, then it is possible to stop a spark discharge rapidly and reliably during the discharge. Consequently, the generation of unnecessary heat in the ignition coil due to re-energization can be suppressed.

Moreover, when the circulation device causes the primary coil to be re-energized with current by the repeat discharge device, it is possible to stop a spark discharge rapidly and reliably during discharge, by switching the second switch to a connected state.

Moreover, the re-energization device is able to stop the spark discharge rapidly and reliably during the discharge, by adjusting the re-energization time in accordance with the amount of energy accumulated in the primary coil in order to generate a spark discharge. Consequently, the generation of unnecessary heat in the ignition coil due to re-energization can be suppressed.

Moreover, by detecting the current differential value, which is the amount of change in the current flowing in the primary coil, the re-energization device is able to end re-energization by switching the first switch to a disconnected state, when the amount of change in the current is equal to or less than a determination value. As a result of this, it is possible to stop the spark discharge rapidly and reliably during the discharge, and the generation of unnecessary heat in the ignition coil due to re-energization can be suppressed.

Second Embodiment

Figure 7:
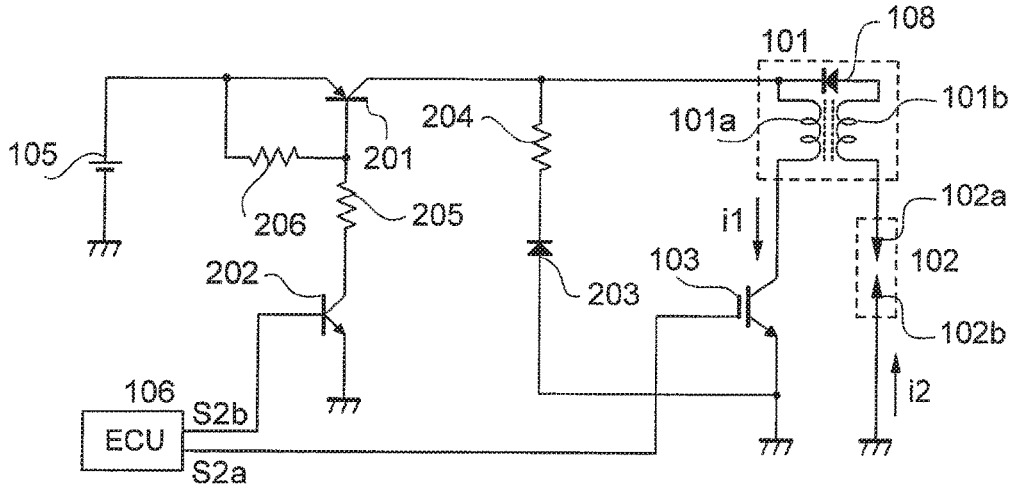
FIG. 7 is an electrical circuit diagram showing the specific configuration of a discharge stopping device according to a second embodiment of the present invention.

FIG. 7 is an electrical circuit diagram showing the specific configuration of a discharge stopping device according to a second embodiment of the present invention. As illustrated in FIG. 7, the configuration of the discharge stopping device according to the second embodiment of the present invention includes an ignition coil 101, an ignition plug 102, an IGBT 103, a power source device (battery) 105, an ECU 106, transistors 201, 202, a unidirectional energization element 203 and resistances 204 to 206.

The ignition coil 101 is constituted by a primary winding 101*a* and a secondary winding 101*b*. The ignition plug 102 is provided in a cylinder of an internal combustion engine. The IGBT 103 is connected in series to the primary winding 101*a*, and when switched on, shorts the two ends of the primary winding 101*a*.

The power source device (battery) 105 supplies a voltage of 12 V, for example, as magnetic energy for discharge. The ECU 106 respectively outputs a first command signal S1*a* and a second command signal S1*b*.

The transistor 201 constitutes a power source switch. Furthermore, the transistor 202 controls on/off switching of the transistor 201. The unidirectional energization element 203 is connected in parallel to the primary winding 101*a* of the ignition coil 101.

The resistance 204 is connected in series to the unidirectional energization element 203. A resistance 205 is connected between the base of the transistor 201 and the connector of the transistor 202 of which the emitter is earthed. Moreover, the resistance 206 is connected between the emitter and the base of the transistor 201.

Here, the resistance 204 represents the resistance component of the closed loop path of the primary winding 101*a* when the transistor 201 is off and the IGBT 103 is on, and includes the forward direction resistance and the wiring resistance, etc. of the unidirectional energization element 203.

One end of the primary winding 101*a* is connected to the collector of the transistor 201, and the other end thereof is connected to the collector of the IGBT 103. Furthermore, one end of the secondary winding 101*b* is connected to the one end of the primary winding 101*a* that is connected to the positive electrode of the power source device 105, via the rectifying element 108. Moreover, the other end of the secondary winding 101*b* is connected to the central electrode 102*a* of the ignition plug 102.

The lateral electrode 102*b* of the ignition plug 102 is earthed to a ground of the same potential as the negative electrode of the power source device 105. Furthermore, the base of the IGBT 103 is connected to the ECU 106, and the emitter of the IGBT 103 is earthed to ground.

The positive electrode-side output terminal of the power source device 105 is connected to the emitter of the transistor 201. The base of the transistor 201 is connected via a resistance 205 to the connector of the transistor 202 of which the emitter is earthed. A resistance 206 is connected between the emitter and base of the transistor 201. The gate of the transistor 202 is connected to the ECU 106.

Furthermore, a diode which constitutes the unidirectional energization element 203 is connected in parallel with the primary winding 101*a* of the ignition coil 101, with the anode towards the earth side. One end of the resistance 204 is connected to the emitter of the transistor 201, and the other end thereof is connected to the cathode side of the diode which constitutes the unidirectional energization element 203.

Current does not flow in the primary winding 101*a* when the IGBT 103 is in an off state due to the first command signal S2*a* output from the ECU 106 to the IGBT 103 being at a low level, which generally corresponds to a ground potential, or when the transistor 201 is in an off state due to the second command signal S2*b* output from the ECU 106 to the transistor 202 being at a low level, which generally corresponds to a ground potential.

Furthermore, if the first command signal S2*a* is at high level, the IGBT 103 is on, and the second command signal S2*b* is at high level and the transistor 202 is on, then a current path is formed in the primary winding 101*a* from the positive electrode side of the power source device 105 towards the negative electrode side of the power source device 105, via the primary winding 101*a* of the ignition coil 101, and a primary current i1 flows in the primary winding 101*a*.

Consequently, when the first command signal S2*a* and the second command signal S2*b* are both at high level, and the primary current i1 is flowing in the primary winding 101*a*, then if the first command signal S2*a* is switched to a low level, the IGBT 103 is turned off and the energization of the primary winding 101*a* with the primary current i1 is shut off.

Therefore, a high voltage for ignition is generated in the secondary winding 101*b* of the ignition coil 101. By applying this high voltage for ignition to the ignition plug 102, a spark discharge is generated between the electrodes 102*a* and 102*b* of the ignition plug 102.

The ignition coil 101 is configured in such a manner that a negative high voltage for ignition which is lower than the ground potential is generated on the central electrode 102*a* side of the ignition plug 102, by shutting off the energization of the primary winding 101*a* by means of the IGBT 103. As a result of this, the secondary current i2 flowing in the secondary winding 101*b* in accordance with the spark discharge flows from the central electrode 102*a* of the ignition plug 102, through the secondary winding 101*b*, to the primary winding 101*a* side.

Furthermore, a rectifying element 108 constituted by a diode, or the like, is provided in the connecting portion between the secondary winding 101*b* and the primary winding 101*a*, in order to permit the flow of current in the forward direction from the secondary winding 101*b* to the primary winding 101*a* side, and to inhibit the flow of current in the opposite direction.

In the specific example in the second embodiment illustrated in FIG. 7, a diode of which the anode is connected to the secondary winding 101*b* and the cathode is connected to the primary winding 101*a* is provided as the rectifying element 108. Current is prevented from flowing to the secondary winding 101*b* when the IGBT 103 is turned on, in other words, at the start of the energization of the primary winding 101*a*, by the operation of this rectifying element 108.

In the second embodiment, one end of the rectifying element 108 is connected to the secondary winding 101*b*, but similar effects can be obtained with a configuration in which one end of the rectifying element 108 is connected to ground.

Next, when the first command signal S2*a* which is output from the ECU 106 to the IGBT 103 is at high level and the second command signal S2*b* which is output from the ECU 106 to the transistor 202 is at low level, then the two ends of the primary winding 101*a* of the ignition coil 101 are shorted.

As a result of this, a closed loop is formed by the primary winding 101*a*, the diode 203 and the resistance 204. Due to the diode 203, the current flowing in the primary winding 101*a* is permitted to flow only in the same direction as the direction in which the current flows when the primary current i1 is energized.

Figure 8:
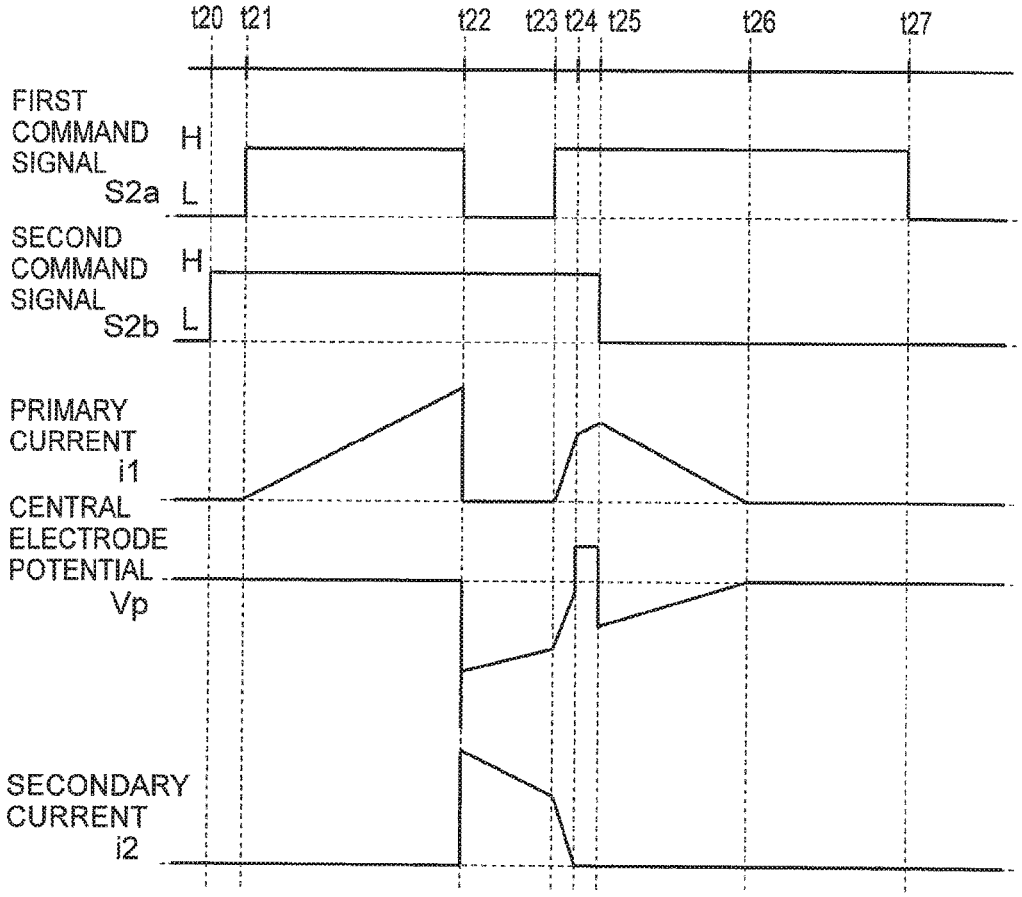
FIG. 8 is a time chart illustrating the waveforms of the respective units of a discharge stopping device provided with the circuit configuration in FIG. 7 according to the second embodiment of the present invention.

Next, a series of operations of the circuit configuration in FIG. 7 will be described with reference to a timing chart. FIG. 8 is a time chart illustrating the waveforms of the respective units of a discharge stopping device provided with the circuit configuration in FIG. 7 according to the second embodiment of the present invention.

More specifically, FIG. 8 shows a timing chart depicting, in order from the top, the states of the first command signal S2*a*, the second command signal S2*b*, the primary current i1 flowing in the primary winding 101*a* of the ignition coil 15, the potential Vp of the central electrode 102*a* of the ignition plug 102, and the secondary current i2 flowing in the secondary winding 101*b* of the ignition coil 101, in the circuit diagram illustrated in FIG. 7.

At time t20, the ECU 106 switches the second command signal S2*b* from low level to high level, and at time t21 thereafter, the ECU 106 switches the first command signal S2*a* from low level to high level. As a result of this, a primary current i1 flows in the primary winding 101*a* of the ignition coil 101.

Thereupon, the ECU 106 switches the first command signal S2*a* from high level to low level, at time t22 when a preset energization time has elapsed, and the energization of the primary winding 101*a* of the ignition coil 101 with the primary current i1 is shut off.

As a result of this shutting off, a negative high voltage for ignition is applied to the central electrode 102*a* of the ignition plug 102, the potential Vp thereof falls suddenly, and a spark discharge is generated between the electrodes 102*a* and 102*b* of the ignition plug 102.

At time t23 when a spark discharge hold time, which is calculated on the basis of the operational state of the internal combustion engine, has elapsed after generation of a spark discharge between the electrodes 102*a* and 102*b* of the ignition plug 102, the ECU 106 switches the first command signal S2*a* again from low level to high level. As a result of this, a primary current i1 for re-energization starts to flow in the primary winding 101*a*.

At time t24 where the primary current i1 for re-energization reaches a current value which generates a magnetic field H corresponding to the magnetic flux Φ remaining in the iron core of the ignition coil 101, a voltage of opposite polarity to the high voltage for ignition that was generated in the secondary winding 101*b* during generation of a spark is induced in the secondary winding 101*b*. As a result of this, when the voltage between the electrodes 102*a* and 102*b* falls below the discharge hold voltage, the spark discharge in the ignition plug 102 is compulsorily shut off.

The greater the magnetic flux Φ remaining in the iron core, the higher the primary current i1 at which the spark discharge is stopped. Therefore, the greater the magnetic flux Φ remaining in the iron core, the longer the required re-energization time.

If re-energization continues after the discharge has stopped, then an unnecessary magnetic flux Φ is stored additionally in the coil. Therefore, the ECU 106 stops re-energization by switching the second command signal S2*b* from high level to low level, at a re-energization end time t25 which is calculated by the re-energization time calculation means.

The two ends of the primary winding 101*a* are shorted at time t25. As a result of this, after re-energization, the primary current i1 starts to flow in the closed loop formed by the primary winding 101*a*, the diode 203 and the resistance 204, due to the magnetic flux Φ remaining in the ignition coil 101.

The second embodiment describes a case where the second command signal S2*b* is on during the spark discharge after time t22. However, the second command signal S2*b* may be switched off after time t22 and the second command signal S2*b* may be switched on again before time t23.

Similarly to the first embodiment above, when the resistance component 204 of the closed loop path of the primary winding 101*a* becomes greater, the primary current i1 does not rise up to a current value that generates a magnetic field H corresponding to the magnetic flux Φ, and a voltage of the same polarity as the high voltage for ignition is generated again in the ignition plug 102. However, the repeat insulation breakdown voltage is a much higher voltage (several kV to several tens of kV) than the discharge hold voltage (approximately several hundred V). Therefore, a repeat spark discharge does not occur between the electrodes 102*a* and 102*b* of the ignition plug 102.

The magnetic flux Φ remaining in the ignition coil 101 is consumed by the internal resistance of the primary winding 101*a* and the resistance component 204 of the closed loop path, and the primary current i1 gradually declines. Therefore, at time t26 where the magnetic flux has been consumed, the primary current i1 ceases to flow.

Thereupon, at time t27, the ECU 106 turns off the IGBT 103 by switching the first command signal S2*a* from a high level to a low level. As a result of this, the closed loop formed by the primary winding 101*a*, the diode 203 and the resistance 204 is released. In this way, the spark discharge in one combustion cycle of the internal combustion engine is ended.

As described above, the discharge stopping device according to the second embodiment applies a high voltage for ignition, which is induced in a secondary winding of an ignition coil by energizing and then shutting off the primary winding, to an ignition plug, and thereby generates a spark discharge between the electrodes of the ignition plug.

At a spark discharge hold time calculated on the basis of the operational state of the internal combustion engine, the primary winding is re-energized for a short period of time, a voltage of opposite polarity to the high voltage for ignition generated in the secondary winding during generation of a spark is induced in the secondary winding, and the discharge is stopped by compulsorily shutting off the spark discharge in the ignition plug.

After this re-energization for a short period of time, since the magnetic flux is consumed by the path which shorts both ends of the primary winding, the discharge on the secondary winding is shut off rapidly and reliably, even in cases where the closed loop path of the primary winding has a high resistance value. Furthermore, the re-energization time is controlled optimally by the re-energization time calculation means, and wasteful generation of heat does not occur in the ignition coil.

The present invention is not limited to the first and second embodiments described above, and can also adapt various modes such as those indicated below. In the first and second embodiments, the re-energization means for the primary winding is shared with a primary energization means, such as a power source device, ignition switch, for supplying electrical energy for discharge. However, it is also possible to stop the spark discharge by the ignition device rapidly and reliably during discharge in a similar fashion, by providing, for example, a new power source or switching means especially for the re-energization means, separately from the primary energization path.

Furthermore, even if the ignition device for an internal combustion engine is configured in such a manner that both ends of the primary winding are shorted using a transistor, or the like, instead of a unidirectional element, such as a thyristor or diode, it is still possible to short the primary winding and to consume the remaining magnetic flux in the ignition coil.

Furthermore, a current detection resistance was used as a re-energization current detection means, but the current detection means may use any means, such as a current transformer. Moreover, the installation position of the current detection means may be at any desired position, for example, between the ignition switch and the primary winding, provided that the current in the primary winding can be detected thereby.

Moreover, in the first and second embodiments described above, the control of the switches was performed by a ECU controller, but it is also possible to adopt a configuration wherein a re-energization control process unit for controlling re-energization in the primary coil and a circulation control process unit for controlling circulation in the current circulation path connecting both ends of the primary coil are provided individually in the controller.

What is claimed is:

1. A discharge stopping device for stopping a spark discharge, during discharge, in an ignition device for an internal combustion engine, the discharge stopping device comprising:

an ignition plug which has a first electrode and a second electrode opposing each other via a gap, and which ignites a combustible air mixture in a combustion chamber of an internal combustion engine by generating a spark discharge in the gap;

an ignition coil including a primary coil and a secondary coil which is magnetically coupled with the primary coil;

a power source device which supplies current to the primary coil;

a first switch which is disposed between the primary coil and the power source device and which switches the current supplied from the power source device between a connected state and a disconnected state; and a controller which causes the primary coil to be energized with current by switching the first switch to a connected state such that energy for causing the ignition plug to generate the spark discharge sufficient to ignite the combustible air mixture is accumulated in the primary coil, and switches the first switch to a disconnected state and shuts off the current when the energy has been accumulated in the primary coil, such that a high voltage is generated in the secondary coil and the spark discharge is generated in the gap of the ignition plug by the high voltage, the discharge stopping device further comprising a second switch which is disposed in a current circulation path connecting both ends of the primary coil and which switches the current circulation path between a connected state and a disconnected state, wherein the controller includes:

a re-energization control process unit which switches the first switch to a connected state and re-energizes the primary coil with current during occurrence of the spark discharge; and a circulation control process unit which switches the second switch to a connected state and sets the current circulation path to a connected state during occurrence of the spark discharge, and the discharge stopping device stops the spark discharge during discharge by using the re-energization control process unit and the circulation control process unit, wherein the re-energization control process unit detects an amount of change in the current flowing in the primary coil, and switches the first switch to a disconnected state and ends the re-energization when the amount of change in the current is equal to or less than a preset threshold value.

2. The discharge stopping device according to claim 1, wherein the re-energization control process unit switches the first switch to a disconnected state and ends the re-energization, when the circulation control path is set to a connected state by the circulation control process unit.

3. The discharge stopping device according to claim 1, wherein the circulation control process unit switches the second switch to a connected state, when the primary coil is re-energized with the current by the re-energization control process unit.

4. The discharge stopping device according to claim 2, wherein the circulation control process unit switches the second switch to a connected state, when the primary coil is re-energized with the current by the re-energization control process unit.

5. The discharge stopping device according to claim 1, wherein the re-energization control process unit adjusts a duration of the re-energization in accordance with an amount of the energy accumulated in order for the primary coil to generate the spark discharge.

6. The discharge stopping device according to claim 2, wherein the re-energization control process unit adjusts a duration of the re-energization in accordance with an amount of the energy accumulated in order for the primary coil to generate the spark discharge.

7. The discharge stopping device according to claim 3, wherein the re-energization control process unit adjusts a duration of the re-energization in accordance with an amount of the energy accumulated in order for the primary coil to generate the spark discharge.

8. The discharge stopping device according to claim 4, wherein the re-energization control process unit adjusts a duration of the re-energization in accordance with an amount of the energy accumulated in order for the primary coil to generate the spark discharge.

* * * * *